US005145331A

United States Patent [19]

Goes et al.

[11] Patent Number: 5,145,331

[45] Date of Patent: Sep. 8, 1992

[54] DIAPHRAGM PUMP

[75] Inventors: Wilfried Goes, Meersburg; Gerhard Gebauer, Bermatingen, both of Fed. Rep. of Germany

[73] Assignee: J. Wagner GmbH, Fed. Rep. of Germany

[21] Appl. No.: 737,426

[22] Filed: Jul. 29, 1991

[51] Int. Cl.[5] ..... F04B 43/06; F01B 25/26

[52] U.S. Cl. ..... 417/383; 417/63; 417/385; 92/97; 92/5 R

[58] Field of Search ..... 417/383, 385–388, 417/395, 63, 413; 92/97, 98 R, 5 R

[56] References Cited

U.S. PATENT DOCUMENTS

| | | | |
|---|---|---|---|
| 3,131,638 | 5/1964 | Wilson | 417/395 |
| 3,431,823 | 3/1969 | Orlita | 417/63 |
| 3,606,566 | 9/1971 | Vetter | 417/63 |
| 4,403,924 | 9/1983 | Gebauer et al. | 417/388 |
| 4,569,634 | 2/1986 | Mantell | 417/295 |
| 4,740,139 | 4/1988 | Mantell | 417/395 |
| 4,785,719 | 11/1988 | Bachschmid et al. | 92/95 |
| 4,787,825 | 11/1988 | Mantell | 417/395 |
| 4,828,464 | 5/1989 | Maier et al. | 417/388 |
| 4,881,876 | 11/1989 | Laziou | 417/395 |
| 4,915,017 | 4/1990 | Perlov | 92/5 R |
| 4,934,902 | 6/1990 | Mantell | 417/63 |
| 4,966,528 | 10/1990 | Henkel | 417/386 |
| 4,971,523 | 11/1990 | Wacker et al. | 417/63 |

FOREIGN PATENT DOCUMENTS

| | | | |
|---|---|---|---|
| 1453454 | 4/1964 | Fed. Rep. of Germany | 417/495 |
| 1800018 | 8/1969 | Fed. Rep. of Germany . | |
| 2624129 | 3/1977 | Fed. Rep. of Germany . | |
| 823633 | 4/1981 | U.S.S.R. | 417/495 |

*Primary Examiner*—Richard A. Bertsch
*Assistant Examiner*—Peter Koryinyk
*Attorney, Agent, or Firm*—Hill, Van Santen, Steadman & Simpson

[57] ABSTRACT

In a diaphragm or membrane pump, the diaphragm thereof is composed of two diaphragm disks arranged at an axial distance from one another and enclosing an interior space whose size is variable given damage to one of the diaphragm disks. Further, a signal generator is arranged in that diaphragm disk facing toward the conveying chamber and a signal pick-up is arranged in the pump housing, this signal pick-up being connected to a means for the electronic evaluation and amplification of the signals output by the signal pick-up. This embodiment makes it possible to recognize a potential damage to the diaphragm early and to thus reliably prevent hydraulic medium from proceeding into the conveyed medium.

13 Claims, 3 Drawing Sheets

DIAPHRAGM PUMP

BACKGROUND OF THE INVENTION

The invention is directed to a diaphragm pump comprising a diaphragm or membrane having its outer edge region clamped in a pump housing and driveable in oscillating fashion on the basis of a hydraulic medium, a conveying chamber of the diaphragm pump being separated by the diaphragm from a drive chamber that accepts the hydraulic medium, whereby the diaphragm is composed of two diaphragm disks that are arranged at an axial distance from one another and enclose an interior space whose size is variable given damage to one of the diaphragm disks.

In order to be able to recognize potential damage to the diaphragm in a diaphragm pump, DE-A-18 00 018 discloses that the diaphragm be composed of a plurality of individual diaphragms, for example of three individual diaphragms pressing against one another and that the space between the individual diaphragms be completely filled with hydraulic medium and be connected to a supply reservoir via a conduit equipped with a check valve. Given a rupture of one of the two outer diaphragms, thus, the medium to be conveyed from the conveying chamber or the hydraulic medium from the work chamber can flow into the supply reservoir and thereby trigger the display mechanism.

The line part that connects the space between the individual diaphragms to the supply reservoir comprises only an extremely narrow capillary cross section, at least in the clamping region of the diaphragms that is pressure-tight around 250 bar. Particularly given conveying medium provided with solids particles, this line part consequently clogs easily, leading to the outage of the function of the flow display.

In addition to the considerable structural outlay of this design, the display means is extremely insensitive since it responds to a level change of the hydraulic medium in the supply reservoir, what is particularly of further disadvantage is that a relatively large quantity of the hydraulic medium situated in the space between the diaphragms and in the conduit connecting this space to the supply reservoir proceeds therefrom into the conveyed medium given damage to the individual diaphragm facing toward the conveying chamber. This can lead to considerable down times as well as to the production of rejects, so that the smooth execution of a continuous manufacture deteriorates greatly. For example, in this type of monitoring, the diaphragm rupturing can therefore not be utilized in paint sprayer devices, particularly since a recognition of rupture only becomes possible when one of the two outer diaphragms is damaged to such an extent that conveyed or hydraulic medium additionally proceeds into the component parts allocated to the display means.

SUMMARY OF THE INVENTION

It is therefore an object of the invention to fashion a diaphragm pump of the aforementioned type in such a way that potential damage to the diaphragm can be recognized early and that, moreover, the hydraulic medium can be reliably prevented from proceeding into the conveyed medium. The structural outlay required for this purpose should be kept low; nonetheless, a high sensitivity and a low susceptibility to malfunction in the monitoring of the diaphragm should be established.

In a diaphragm pump of the aforementioned type that comprises a diaphragm composed of two diaphragm disks arranged at an axial distance from one another and enclosing an interior space, whereby the size of the interior space is variable given damage to one of the diaphragm disks, this is inventively achieved in that a signal generator is arranged in the diaphragm disk facing toward the conveying chamber and a signal pick-up is arranged in the pump housing in the region of the drive chamber, this signal pick-up being connected to a means for electronic evaluation and amplification of the signals output by the signal pick-up.

Although DE-A-26 24 129 as well as U.S. Pat. No. 4,934,902 already disclose electrical or, respectively, magnetic methods for signalling a rupture of a diaphragm in a magnetic pump, arranging a signal generator in the diaphragm disk facing toward the conveying chamber and a signal pick-up in the region of the drive chamber are not provided in these disclosures.

It is also expedient, given the diaphragm pump of the invention, to fill out the interior space of the diaphragm gas-free with an incompressible medium preferably compatible with the conveyed medium, for example with water, with a dilution of the conveyed medium or the like, and/or to provide the interior space of the diaphragm with an underpressure, so that the two diaphragm disks oscillate synchronized with one another in their intact condition but, given the formation of a crack in one of the diaphragm disks, their axial spacing relative to one another and/or relative to the signal pick-up is changed due to the penetration of conveyed medium or of the hydraulic medium.

In order to support the attitudinal change in such a case, an axially direct, pre-stressed compression spring can be additionally introduced, preferably centrally, into the inside space of the diaphragm.

The signal generator is formed by a high-energy magnet, preferably composed of a samarium-cobalt alloy.

It is also applicable to introduce the signal generator centrally in the diaphragm disk facing toward the conveying chamber, preferably in a thickened portion applied to this diaphragm disk, whereby the signal generator can be injected into the diaphragm disk or can be introduced into a recess of the diaphragm disk and can be firmly connected thereto by an ultrasound or hot-air welding, by gluing, by pressing or the like.

The signal pick-up can be fashioned as a magnetoristic magnetic field sensor and can preferably have its side facing away from the signal generator provided with a magnetic lamina for generating a permanent-magnetic bias field for stabilization.

It is also advantageous to arrange the signal pick-up in an enclosed cylinder, preferably one composed of a non-ferromagnetic material, for example titanium, that should be inserted into the pump housing radially adjustable vis-a-vis the axis of the diaphragm.

The two diaphragm disks should be firmly joined to one another in their outer edge region by gluing, by ultrasound or hot-air welding or in a similar way.

When a diaphragm pump is fashioned in conformity with the invention, wherein the diaphragm is composed of two diaphragm disks whereof one comprises a signal generator that collaborates with a stationarily arranged signal pick-up, then it is possible to monitor the operating condition of the diaphragm in a very simple way but nonetheless extremely reliably and to recognize potential damage to one of the two diaphragm disks early. When, namely, the formation of a crack or a rupture occurs in one of the diaphragm disks, then at least one of the ultimate positions of the diaphragm disk bearing the signal generator immediately changes vis-a-vis the signal pick-up since the embedded medium flows out of the double-wall diaphragm and medium is suctioned thereinto or is introduced thereinto under pressure. This positional change can also be detected and evaluated by a signal pick-up, so that a formation of a crack in one of the diaphragm disks can be recognized. When the diaphragm disk facing toward the conveying chamber is damaged, the diaphragm pump nonetheless remains operational and no immediate interruption in operation need be accepted. On the contrary, the damaged diaphragm can be replaced at a suitable time, for example at the end of a day's work, without the occurrence of a greater interruption in operations.

When the diaphragm disk facing toward the drive chamber is damaged, the space between the two diaphragm disks fills with hydraulic medium; as a result thereof, the diaphragm disk facing toward the conveying chamber is pressed into its ultimate displaced position, resulting therein that the pump no longer conveys.

Since the diaphragm with which the conveying chamber is separated from the drive chamber is double-walled, no hydraulic medium, consequently can proceed into the conveying chamber and no hydraulic medium can proceed into the hydraulic system even given a leak in one of the diaphragm disks. Given the employment of such a diaphragm pump in a paint sprayer means, thus, the paint unit and the object to be coated are reliably protected against contamination with hydraulic medium since the inside space between the diaphragms can be filled with a liquid that is compatible with the medium to be conveyed. The production of rejects is thus largely avoided, even given a rupture of the diaphragm disk facing toward the conveying chamber. Since it is not only a reliable, early recognition but also a high sensitivity given the recognition system fashioned in accord with this proposal that are guaranteed, despite the low structural outlay, an economical and extremely versatile employment is established.

BRIEF DESCRIPTION OF THE DRAWINGS

The drawing shows an exemplary embodiment of the diaphragm pump fashioned in conformity with the invention, this being set forth in detail below. Thereby shown are.

DETAILED DESCRIPTION OF THE PREFERRED EMBODIMENTS

Figure 1:
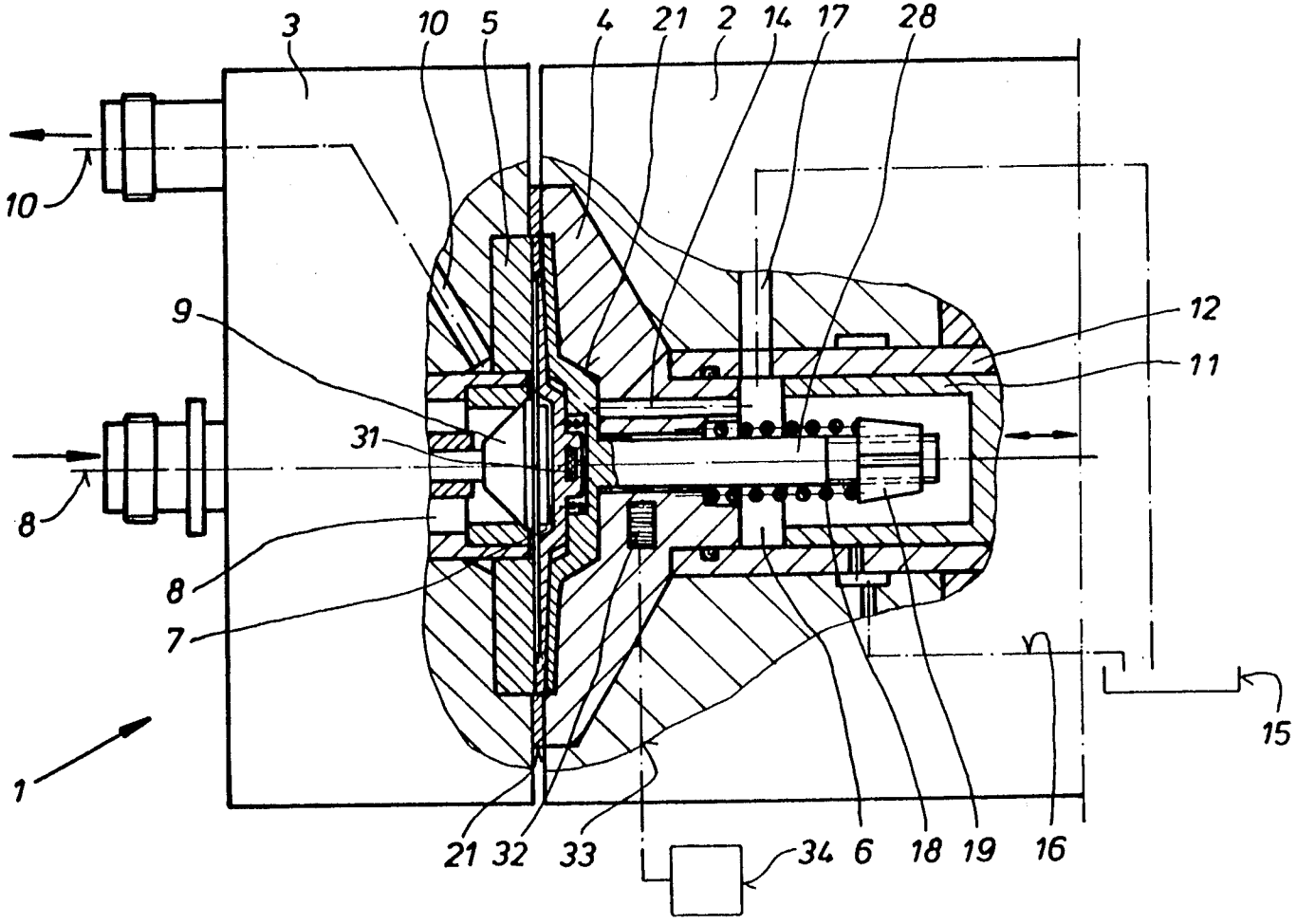
FIG. 1 is a side view of a high-pressure pump equipped with a double-walled diaphragm, shown partially in section.

The diaphragm pump 1 of FIG. 1 is essentially composed of a driven diaphragm 21 clamped between two housing parts 2 and 3 provided with seating disks 4 or, respectively, 5, this driven diaphragm 21 separating a working chamber 6 from a conveying chamber 7. A piston 11 that is displaceably introduced in a cylinder 12 serves the purpose of driving the diaphragm 21, this piston 11 being driven by a drive means (not shown here), for example by an eccentric or cam. The working chamber 6 is connected via a suction line 16 to a supply reservoir 15 to which a return line 17 into which a pressure control valve (not shown) for dampening pressure peaks is connected.

A shaft 28 provided with a threaded section is attached to the diaphragm 21, a nut 19 being screwed onto the shaft 28. A compression spring 18 is introduced between the seating disk 4 and the nut 19, the diaphragm 21 thus always being pressed back by this compression spring 18 into the initial position in which the diaphragm 21 presses against the seating disk 4. During a suction stroke, the medium to be conveyed is suctioned into the conveying chamber 7 via a suction line 8 that is equipped with an admission valve 9 and, during a delivery stroke given a closed admission valve 9, the medium to be conveyed is conveyed into a pressurized line 10 that, of course, is also equipped with a check valve (not shown).

Figure 3:
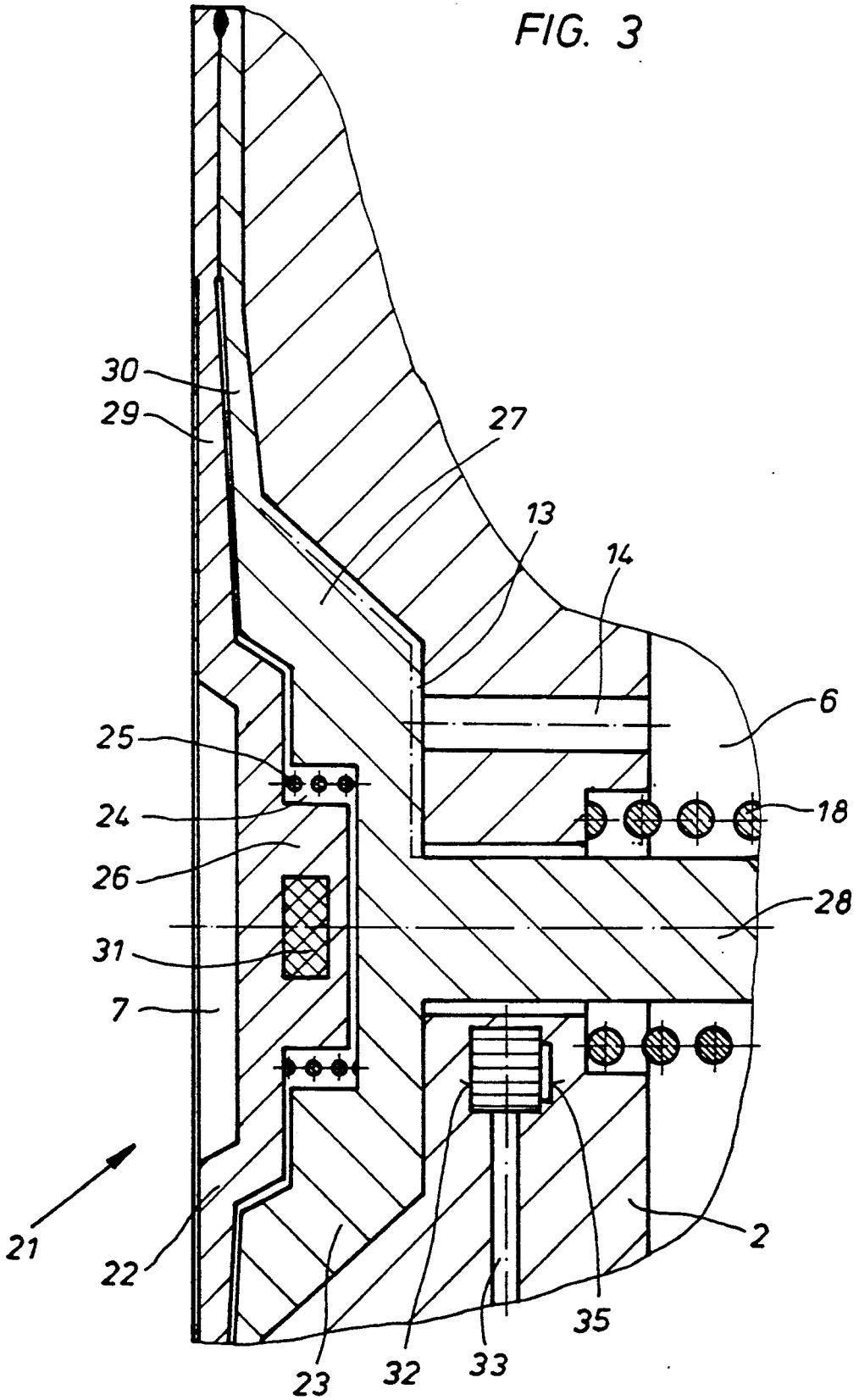
FIG. 3 is a further enlarged partial side sectional view of the diaphragm comprising seating disks of FIG. 1 as a discrete part with a modified arrangement of the signal pick-up.

As may be derived in detail from FIG. 3, the diaphragm 21 is composed of two diaphragm disks 22 and 23 arranged at an axial distance from one another that thus enclose an interior space 24 and that each respectively comprise a central thickened portion 26 and 27 as well as a flexing zone 29 and 30 following upon an outer clamping region. A pre-stressed compression spring 25 is also introduced into the interior space 24 that, in the illustrated exemplary embodiment, is filled out with a gas-free, non-compressible fluid that is compatible with the medium to be conveyed.

When one of the two diaphragm disks 22 or 23 is damaged, then the medium situated between these will flow out either into the working chamber 6 or into the conveying chamber 7; at the same time, however, medium will flow out of one of these chambers into the interior space 24 under pressure. Particularly since the diaphragm disks 22 and 23 are pressed apart in this operating condition by the pre-stressed spring 25, this, however, effects that the diaphragm disk 22 no longer proceeds into the ultimate position assigned to it given a suction stroke. This change in ultimate position is exploited in order to recognize damage to one of the diaphragm disks 22 and 23.

This is accomplished in such fashion that a signal generator 31, preferably in the form of a high-energy magnet, is built into the thickened portion 26 of the diaphragm disk 22 and a signal pick-up 32 tuned thereto is introduced into the housing part 2, this signal pick-up 32 being connected via a signal line 33 to an electronic means 34 for evaluating and amplifying the signals output by the signal pick-up 31. The signals can be evaluated and amplified such with the electronic means 34 that said signals can be utilized as optical and/or acoustic signals and/or for shutting the diaphragm pump 1 off. Given an error message, the high-pressure pump 1 can thus be deactivated before the diaphragm 21 is damaged to such an extent that the hydraulic medium situated in the working chamber 6 proceeds into the conveying chamber 7. Long down times and serious productions of rejects can thus be reliably avoided.

For the purpose of producing a permanent-magnetic field, the signal pick-up 32 of FIG. 3 can have that side facing away from the diaphragm disk 23 equipped with a magnetic lamina 35 with which the signal pick-up 32 fashioned as a magnetic field sensor is stabilized.

Figure 2:
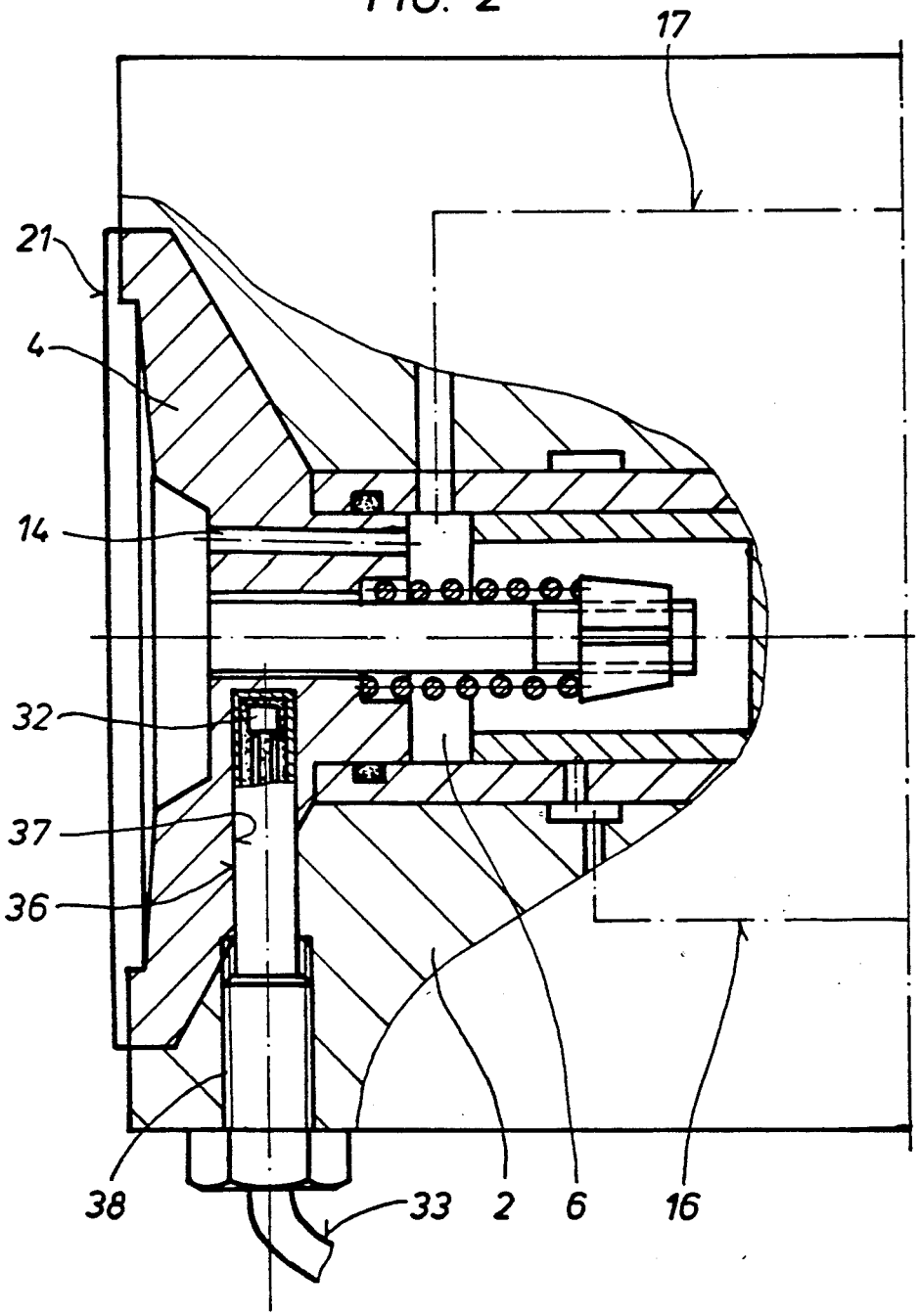
FIG. 2 is an enlarged partial side sectional view of the signal pick-up provided in the high-pressure pump of FIG. 1.

As may be derived from FIG. 2, the signal pick-up 32 is cast out in a cylinder 36 composed of a non-ferromagnetic material, for example titanium, this cylinder 36 being introduced into a bore 37 of housing part 2, and if desired, of the seating disk 4. With the assistance of a threaded bush 38, the cylinder 36 with which the signal pick-up is thus protected against a pressure charging by the hydraulic medium situated in the working chamber 6 is radially adjustable relative to the axis of the diaphragm 21, so that the signal pick-up 32 can be aligned perpendicular to the axis vis-a-vis the signal generator 31.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A diaphragm pump comprising a diaphragm that has its outer edge region clamped in a pump housing and that can be driven in oscillating fashion by a hydraulic medium, a conveying chamber of the diaphragm pump being separated by said diaphragm from a drive chamber that accepts the hydraulic medium, whereby the diaphragm is composed of two diaphragm disks arranged at an axial distance from one another and enclosing an interior space whose size is variable given damage to one of the diaphragm disks, comprising a signal generator arranged in that diaphragm disk facing toward the conveying chamber and a signal pick-up arranged in the pump housing in the region of the drive chamber, said signal pick-up being connected to a means for the electronic evaluation and amplification of signals output by said signal pick-up.

2. A diaphragm pump according to claim 1, wherein said interior space of the diaphragm is filled out gas-free with a non-compressible medium that is compatible with the conveyed medium.

3. A diaphragm pump according to claim 1, wherein said interior space of the diaphragm is evacuated below ambient pressure.

4. A diaphragm pump according to claim 1, wherein an axially directed, pre-stressed compression spring is introduced, preferably centrally, into said interior space of the diaphragm.

5. A diaphragm pump according to claim 1, wherein said signal generator is composed of a high-energy magnet.

6. A diaphragm pump according to claim 1, wherein said signal generator is centrally introduced into that diaphragm disk facing toward the conveying chamber, being preferably introduced therein in a thickened portion of said disk.

7. A diaphragm pump according to claim 6, wherein said signal generator is injected into the diaphragm disk.

8. A diaphragm pump according to claim 6, wherein said signal generator is introduced in a recess of the diaphragm disk and is firmly connected thereto.

9. A diaphragm pump according to claim 1, wherein said signal pick-up is fashioned as a magnetoristic magnetic field sensor.

10. A diaphragm pump according to claim 1, wherein said signal pick-up is provided with a magnetic lamina for generating a permanent-magnetic bias field, being provided therewith at that side facing away from the signal generator.

11. A diaphragm pump according to claim 1, wherein the signal pick-up is arranged in a closed cylinder, made of a non-ferromagnetic material.

12. A diaphragm pump according to claim 11, wherein the cylinder is introduced radially adjustable vis-a-vis an axis of the diaphragm in the pump housing.

13. A diaphragm pump according to claim 1, wherein the two diaphragm disks are firmly joined to one another in their outer edge region.

* * * * *